US008220364B1

(12) United States Patent
Mecham

(10) Patent No.: US 8,220,364 B1
(45) Date of Patent: Jul. 17, 2012

(54) METHOD AND APPARATUS FOR EXTENDING THE USABLE LIFE OF SAFETY RAZORS

(76) Inventor: John Mecham, Chandler, AZ (US)

( * ) Notice: Subject to any disclaimer, the term of this patent is extended or adjusted under 35 U.S.C. 154(b) by 436 days.

(21) Appl. No.: 12/472,228

(22) Filed: May 26, 2009

(51) Int. Cl.
*B24D 15/08* (2006.01)

(52) U.S. Cl. ..... 76/81.6; 76/81; 76/81.5

(58) Field of Classification Search ..... 76/81, 81.1, 76/82, 81.5, 81.6; 451/524, 556
See application file for complete search history.

(56) References Cited

U.S. PATENT DOCUMENTS

| | | | | | |
|---|---|---|---|---|---|
| 271,997 | A | | 2/1883 | Tower et al. | |
| 331,853 | A | * | 12/1885 | Warren | 76/81 |
| 661,694 | A | * | 11/1900 | Hemmerdinger | 76/81.5 |
| 721,654 | A | * | 3/1903 | Anderson | 76/81.6 |
| 739,534 | A | | 9/1903 | Doss | |
| 797,989 | A | * | 8/1905 | Tolman | 76/81.6 |
| 816,635 | A | * | 4/1906 | Zarbock | 76/81.5 |
| 914,147 | A | * | 3/1909 | Krischer | 76/81.6 |
| 949,585 | A | | 2/1910 | Levalley | |
| 970,939 | A | * | 9/1910 | Mihills | 76/81.6 |
| 977,311 | A | | 11/1910 | Hunold | |
| 1,111,873 | A | * | 9/1914 | Tomek | 76/81.5 |
| 1,284,829 | A | * | 11/1918 | Waldheim | 451/316 |
| 1,292,406 | A | * | 1/1919 | Slevin | 451/461 |
| 1,316,403 | A | * | 9/1919 | Williams | 76/81.6 |
| 1,326,784 | A | * | 12/1919 | Richardson | 76/81.6 |
| 1,787,372 | A | * | 12/1930 | Hehnly | 76/81.6 |
| 1,866,384 | A | | 7/1932 | Abranathy | |
| 1,935,080 | A | * | 11/1933 | Davis | 76/81.5 |
| 1,950,291 | A | * | 3/1934 | Biener | 76/81.6 |
| 2,654,194 | A | * | 10/1953 | Raab | 76/81 |
| 2,706,874 | A | | 4/1955 | Carter | |
| 5,445,479 | A | * | 8/1995 | Hillinger | 408/16 |
| 6,062,970 | A | | 5/2000 | Back | |
| 2004/0045407 | A1 | | 3/2004 | Katz | |

FOREIGN PATENT DOCUMENTS

| | | |
|---|---|---|
| GB | 179.887 | 2/1923 |
| GB | 244.323 | 12/1925 |
| GB | 492.772 | 9/1938 |
| GB | 504.037 | 4/1939 |
| GB | 571.682 | 9/1945 |

OTHER PUBLICATIONS http://ebay.com—searched—"Razor Strop".

* cited by examiner

*Primary Examiner* — Hwei C Payer
(74) *Attorney, Agent, or Firm* — Michael I. Kroll

(57) ABSTRACT

A method and apparatus for sharpening/honing safety razors comprising a mini-strop having a body with a rough side and a smooth side made of double shoulder premium cowhide, a handle and a swivel trigger snap and extension strap with hook and loop fastener elements for suspending from an anchoring article.

11 Claims, 6 Drawing Sheets

METHOD AND APPARATUS FOR EXTENDING THE USABLE LIFE OF SAFETY RAZORS

BACKGROUND OF THE INVENTION

1. Field of the Invention

The present invention relates generally to razor strops and, more specifically, to a method and apparatus for extending the usable life of a safety razor. This invention is basically a mini-strop made from cow leather with its main purpose to give a dull, rough safety razor (any safety razor—disposable, and the ones that you just change out the razorhead) a smooth sharp edge again thereby extending the safety razor's life.

The rougher sueded leather side of the strop, hones/sharpens the safety blades edges, while the smoother leather side of the strop smooths out and shapes the safety blade edges, giving them a keen smooth edge.

2. Description of the Prior Art

There are other razor honing devices. Typical of these is U.S. Pat. No. 271,997 issued to Tower & Lamont on Feb. 6, 1883.

Another patent was issued to Doss on Sep. 22, 1903 as U.S. Pat. No. 739,534. Yet another U.S. Pat. No. 949,585 was issued to Levalley on Feb. 15, 1910 and still yet another was issued on Nov. 29, 1910 to Hunold as U.S. Pat. No. 977,311.

Another patent was issued to Abranathy on Jul. 5, 1932 as U.S. Pat. No. 1,866,384. Yet another U.S. Pat. No. 2,706,874 was issued to Carter on Apr. 26, 1955. Another was issued to Rogers on May 16, 2000 as U.S. Pat. No. 6,062,970 and still yet another was published on Mar. 11, 2004 to Katz as U.S. Patent Application Publication No. 2004/0045407.

Another patent was issued to Clark on Feb. 2, 1928 as U.K. Patent No. GB179,887. Yet another U.K. Patent No. GB244,323 was issued to Garnett on Dec. 17, 1925. Another U.K. Patent No. GB492,772 was issued on Sep. 27, 1938 to Geary. Another was issued to Hitchin on Apr. 18, 1939 as U.K. Patent No. GB504,037 and still yet another was issued on Sep. 4, 1945 to Laird as U.K. Patent No. GB571,682.

The combination, in a razor-strop, of the opposing bowed strips b b and coverings c c for the strips, with the tapering block C and handle A, the latter being provided with the tapering part d, corresponding to the block C, said block C and part d placed between the strips b b, at the respective ends thereof, and secured to the latter by suitable means, all substantially as and for the purpose set forth.

As a new article of manufacture a razorstrop composed of a strip of flexible material and having opposite active faces, the body of the strop being provided with a series of closely-arranged unobstructed perforations extending entirely through the same transversely.

A razor strop consisting of a strip of suitable material provided with projections on one side and indentations on its opposite side, substantially as set forth.

In a razor strop, the combination with a pivoted member and means for supporting the same, of clamping plates for holding strops arranged in series in different horizontal planes, and pivotal means for connecting, the plates with the pivoted member.

A razor strop comprising a strip of leather affording an extended stropping surface, said surface having inserted therein a plurality of plugs of leather the exposed surfaces of which extend across the grain of the leather and are substantially flush with the surface of the holding strip.

A sharpening device for safety razor blades comprising an oblong rectangular plate having tubular members at opposite longitudinal edges thereof, said plate being attached to said members in diametrical position relative thereto to be supported on a surface by said members in elevated position with either side of the plate uppermost, said tubular members providing cornerless hand grips, a hone on one side of the plate, and a strop on the other side of the plate, said hone having reduced end ledges thereon extending therefrom and said plate having end pairs of extension lips thereon bent to one side thereof over said ledges to secure the hone to said plate, said plate having end lips thereon bent over to the other side thereof between the lips of the pairs and pressed into the strop to secure the strop to the plate.

A stropping device of a blade for safety razors, capable of allowing an existing razor blade to be repeatedly used, is disclosed. The stropping device consists of a main body and an adhesive sheet attached on the back surface of the main body. A guide groove part is longitudinally formed on a front portion of the main body, while a protrusion is integrally and horizontally formed on a top portion of the main body. Also, side walls are formed at both side ends of the main body in such a manner that their outer surfaces are smoothly curved. A stropping plate member, produced from a leather material such as a natural or synthetic leather or suede, is attached on the bottom surface of the guide groove part by an adhesive means. In addition, a recess is formed on a rear portion of the protrusion in such a manner that a nail, driven in a wall in a house, is inserted into the recess.

An appliance for sharpening razor blades of the type held in a blade cartridge comprises a leather strop bonded onto a magnetic substrate that is in turn bonded onto a support. The width of the strop does not exceed the width of the blades in typical cartridges, so that the blades may rest on the strop when the cartridge is stroked over the strop to hone the blade edges. The surface of the strop is proud of the support surface adjacent the strop, to ensure that edges of the cartridge that are typically proud of the blades do not prevent contact of the blades with the strop. The ends of the strop are secured in undercut formations in the holder.

A razor strop of the type set forth in which the pneumatic tube or the like is interposed longitudinally between a leather and a canvas strap, the ends of which are clamped one above and one below a rigid member through which the neck of the pneumatic tube passes.

A member C of metal, cane, cork, etc. with corrugations on one or both faces is placed between the leather and the canvas sides A of a strop to increase the sharpening action. A thin padding may be placed between the member C and the covering A.

A strop for razors comprises a strip of leather or other flexible material 1 secured at 4 to the thicker end of a wedge-shaped block 2 of wood, vulcanite, or other material, the other end of the strip being spaced away from the thinner end of the block and attached to the bridge portion 10 of a wire spring member 5, the ends 8 of which are driven into the block. Instead of wire spring, coil springs or elastic rubber strands may be employed to tension the strip, and in place of the wedge-shaped block, a block with parallel faces may be used, the strip 1 being inclined to the flat faces of the block; the undersurface of the block may be roughened or provided with rubber, leather projections. A recess 18 may be provided in the block for storage of a holder for safety razor blades constructed according to Specification 484,009. The strop may be attached yieldingly at both ends to the block.

A razor strop comprises a leather &c. strap A folded at X over a bar E, to form two stropping members, the front member B also having its lower end turned back at R and stitched to the two members to form a loop to receive a handle T of undulating form to accommodate the fingers of the user. The front member B is formed with a series of perforations or depressions D and the rear member is left plain. The bar E is mounted in a member F formed of stampings G, which also provide a housing J for a coil spring K engaged at its inner end by a plate L carried by a pin N to which is attached a hook O; in use the strop is pulled so as to tension the spring.

A strop comprises a block on opposite sides of which are strips of leather impregnated with fine and coarse abrasive respectively, the strips being furrowed by a sharp-toothed comb and the abrasive, which may consist of laminated alumina, carborundum powder, or the material sold under the Registered Trade Mark "Aloxite" mixed with an adhesive and an animal or fish oil, forced in.

While these devices may be suitable for the purposes for which they were designed, they would not be as suitable for the purposes of the present invention, as hereinafter described.

SUMMARY OF THE PRESENT INVENTION

The strop of the present invention has two main leather parts the Body and the Handle that are connected together using a combination of sueded leather (rough) with rivets:

The Body is made from double shoulder premium cow leather (soft) strip, preferably 1.5" wide, 8" long and approx. ⅛" inches thick, with one side of the leather sanded with 400 grit fine sand paper creating the smooth leather side, while the other side comprises a strip of sueded leather (soft), preferably 1.5" wide, 8" long and approx. 1 mm thick, that is rubber cemented to the backside of the body making it the rougher leather side.

The Handle is made from 2 pieces of double shoulder premium cow leather (soft) strip, preferably 1.5" wide, 4 5/16" long and approx. ⅜" thick, that are rubber cemented back to back. The leather on both sides of the handle is sanded with the same fine 400 grit sandpaper, which gives the handle a very soft grip. The top of the strop has a swivel trigger snap, preferably 1.5 inches wide, that is connected to the main body by a piece of sheer sueded leather (rough), preferably 2" by 1.5", and two double sided medium rivets. The bottom of the strop has a metal loop, preferably 1.54" wide by 5" long that is connected to the main body by a piece of sheer sueded leather (rough), preferably 2" by 1.5", and two double sided medium rivets. The handle of the strop is connected to the body by the bottom of said metal loop and said piece of sheer sueded leather (rough) connected with two double sided medium rivets. A Velcro strip, preferably ¾" by 8" is provided to make it convenient to hang the strop with the swivel trigger snap as long as you can get the Velcro around an object, you can then connect the trigger snap to it.

The technique for sharpening/honing the safety razors with the present invention starts with a person selecting a spot to hang the strop from, such as a hook, towel rack etc. (preferably waist height.) Taking a clean, dry safety razor, turn the strop to the rougher side—the sueded leather (soft) side. While holding the safety razor just as if you were shaving, place the safety razor at the bottom of the body of the strop resting all blades on the leather just above the sheer sueded leather with the two rivets. Apply slight pressure to the blades against the leather, as the safety razor is drawn to the top of the body. When reached, all pressure is removed from the safety razor as it is lifted off the strop body. Then starting at the bottom repeat the procedure as needed.

Lets say a person performed the above procedure 3 times, it is very important that the person reverse the procedure on the same side—3 times going from the top of the body of the strop to the bottom of the body of the strop—this has two functions: 1. Keeps the wear of the strop even—important the texture of the sueded leather stay even for the proper sharpening/honing of the razor blades. 2. Insure that the blades will be honed/sharpened uniformly all the way across the entire edge. Next, the person would flip the strop over and repeat the same procedures on the smooth leather side—bottom to the top, and repeated the same amount of times top to bottom—this has a similar functions: 1. Keep the wear of strop even-important that the smooth texture created by the 400 grit sand paper stays even for proper smoothness, and shaping of the razor blades edges. 2. Insures that the blades will be uniformly smoothed/shaped across the entire razor blade edges.

The strop is designed to hang from a towel rack, hanger, hook etc. It has a trigger snap hook that swivels so that the strop flips easily from the rougher leather side to the smooth leather side. The hanging design is essential to the successful sharpening/honing on the rougher sueded leather side and the smoothing/shaping on the smooth side. The hanging design allows maximum flexibility of the main body of the leather strop. This flexibility of the strop gives the razor blades a deeper penetration into the leather creating an even distribution all the way across each blade effectively honing/sharpening on the rough sueded leather side and smoothing/shaping on the smoother leather side—1 to 5 blades.

U.S. Pat. No. 6,062,970 shows the leather fixed to a flat molded surface—since the leather strip is not able to flex it cannot hone/sharpen the entire razor evenly all the way across, especially when there are two to five blades on the safety razor. U.S. Pat. No. 6,062,970 there is only one strip of leather, and the purpose of this leather is to hone/sharpen the safety razor's blades. The safety razor will have sharp edges but the razor's edges will be rough and not shaped. A person will have a very rough uncomfortable shave that will cut their hair with a lot of snagging, and pulling. As compared to the sharp, smooth shave of the present invention, U.S. Pat. No. 6,062,970 they only illustrate honing/sharpening the safety razor one way—Top to bottom. This would cause uneven wear on the leather and would also cause uneven distribution honing sharpening across the razor blades.

Comparing the present invention to strops that are made for straight razors discloses many differences:

1. This strop is made from cow leather. Most straight leather strops are made from horse leather.

2. This strop is made to sharpen Safety Razor not a straight razor. Due to its small dimensions, the present invention would not be very effective for sharpening a straight razor.

3. The rough side of strops for straight razors are made from tightly woven canvas while the present invention uses sueded leather (soft).

4. The smooth side of the strop for a straight razor is much more rigid. Sanding the smooth side with 400 grit sandpaper is key for the smooth keen edge of the razor blades on each safety razor. The smooth side would be way too smooth to effectively smooth and shape a straight edge razor.

Invention advantages: Imagine a dull rough safety razor blade you are about to throw away and replace with a new one. After using Razor Renew on the dull rough safety razor, it is sharp and smooth again. It will extend the life of the safety razor blades at least 2 times. Some people depending on use and skin sensitivity will get up to 4 times the use and even longer. Just use as needed.

The object of the present invention is to provide a mini-strop that will extend the usable life of a safety razor by returning dull rough safety razors to a smooth sharp edge again.

Another object of the present invention is provide a mini strop having a body comprising two conditions of leather bonded back to back to provide a rough side and a smooth side.

Yet another object of the present invention is to provide a mini-strop having a pivoting means for securing it to an anchoring article disposed on the top end thereof to provide access to each side of the body.

Still another object of the present invention is to provide a mini-strop having a handle portion disposed on the bottom end thereof for pulling the strop taut.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

DESCRIPTION OF THE REFERENCED NUMERALS

Turning now descriptively to the drawings, in which similar reference characters denote similar elements throughout the several views, the figures illustrate the Method and Operation for Sharpening/Honing Safety Razors of the present invention. With regard to the reference numerals used, the following numbering is used throughout the various drawing figures.

10 Mini-Strop of the present invention
12 safety razor
14 body
16 rough side of 14
18 smooth side of 14
20 swivel trigger snap
22 handle
24 metal loop
26 sueded leather loop
28 medium sized rivet
30 anchoring article
32 extension strap
34 hook and loop fastener element

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. The scope of the present invention is best defined by the appended claims.

Figure 1:
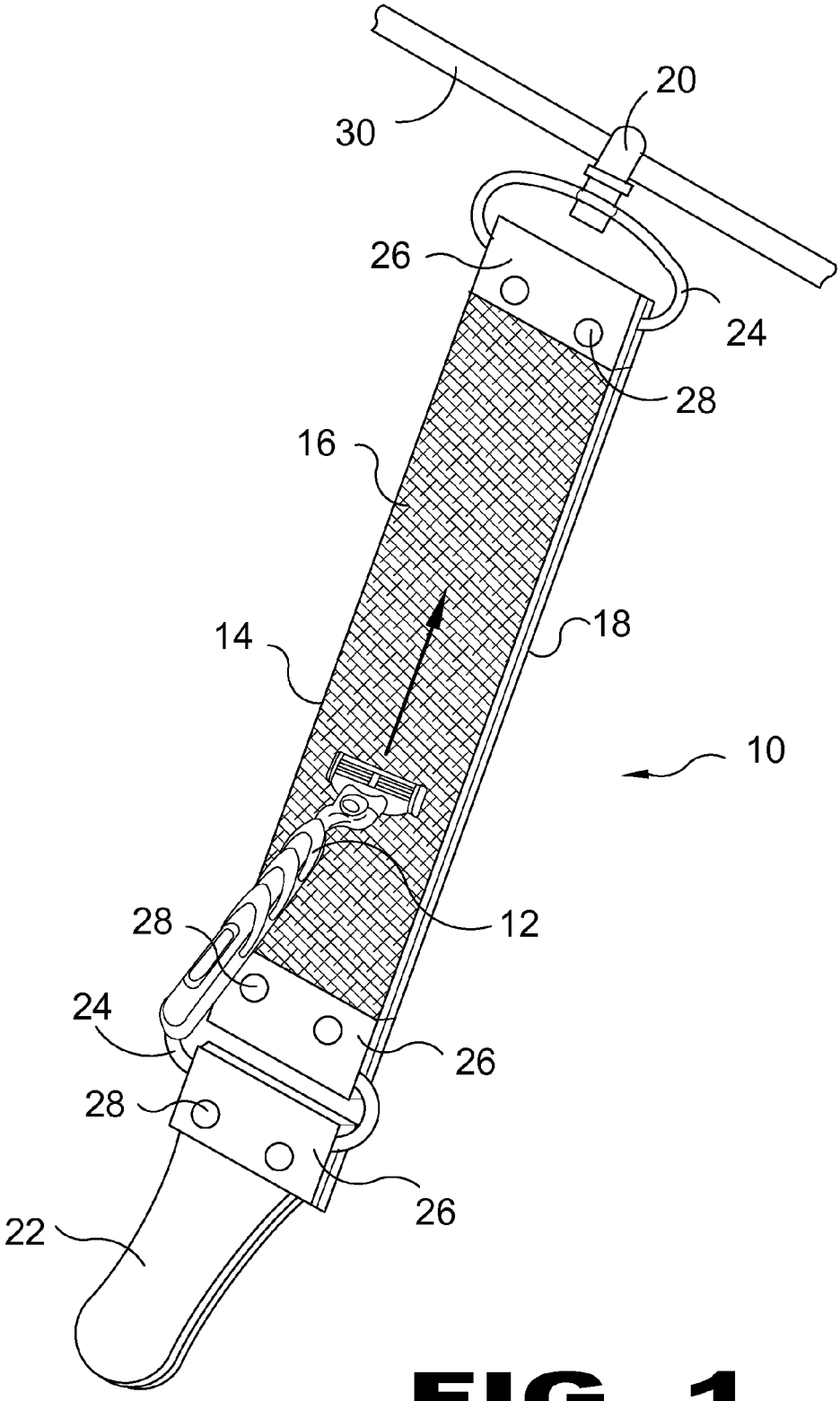
FIG. 1 is an illustrative view of the present invention in use.

FIG. 1 is an illustrative view of the present invention 10 in use. Shown is the present invention being a mini-strop 10 for sharpening/honing a safety razor 12. The strop 10 comprises a body 14 having a rough side 16 and a smooth side 18, a swivel trigger snap 20 and a handle 22. The swivel trigger snap 20 and handle 22 are connected to the body 14 by metal loop 24*s* secured by sheer sueded leather loops 26 each having two medium sized rivets 28. Shown is the swivel trigger snap 20 secured to an anchoring article 30 with the razor 12 being drawn along the rough side 16 of the strop in an upward motion. It is important to equally alternate between upward and downward motions.

Figure 2:
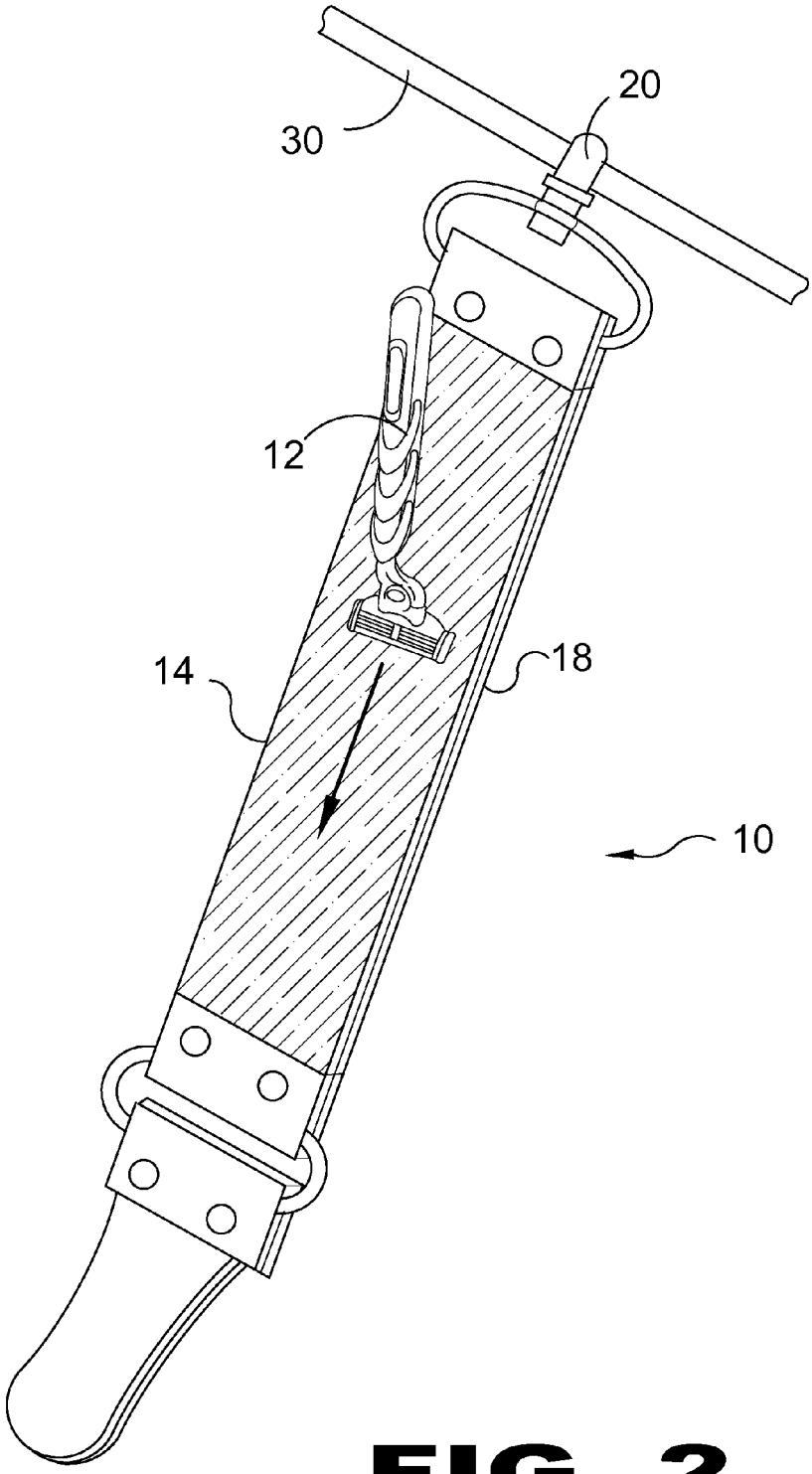
FIG. 2 is an illustrative view of the present invention in use.

FIG. 2 is an illustrative view of the present invention 10 in use. Shown is the mini-strop 10 rotated around the swivel trigger snap 20 secured to the anchoring article 30 to expose the smooth side 18 of the body 14 along which the safety razor 12 being drawn in a downward motion. If you bring the razor down 3 or 4 times you must bring it upward an equal amount of time on the same side to keep wear on the strop even and to insure that the blades are honed/sharpened evenly. The texture of the smooth side 18 is created by 400 grit sandpaper.

Figure 3:
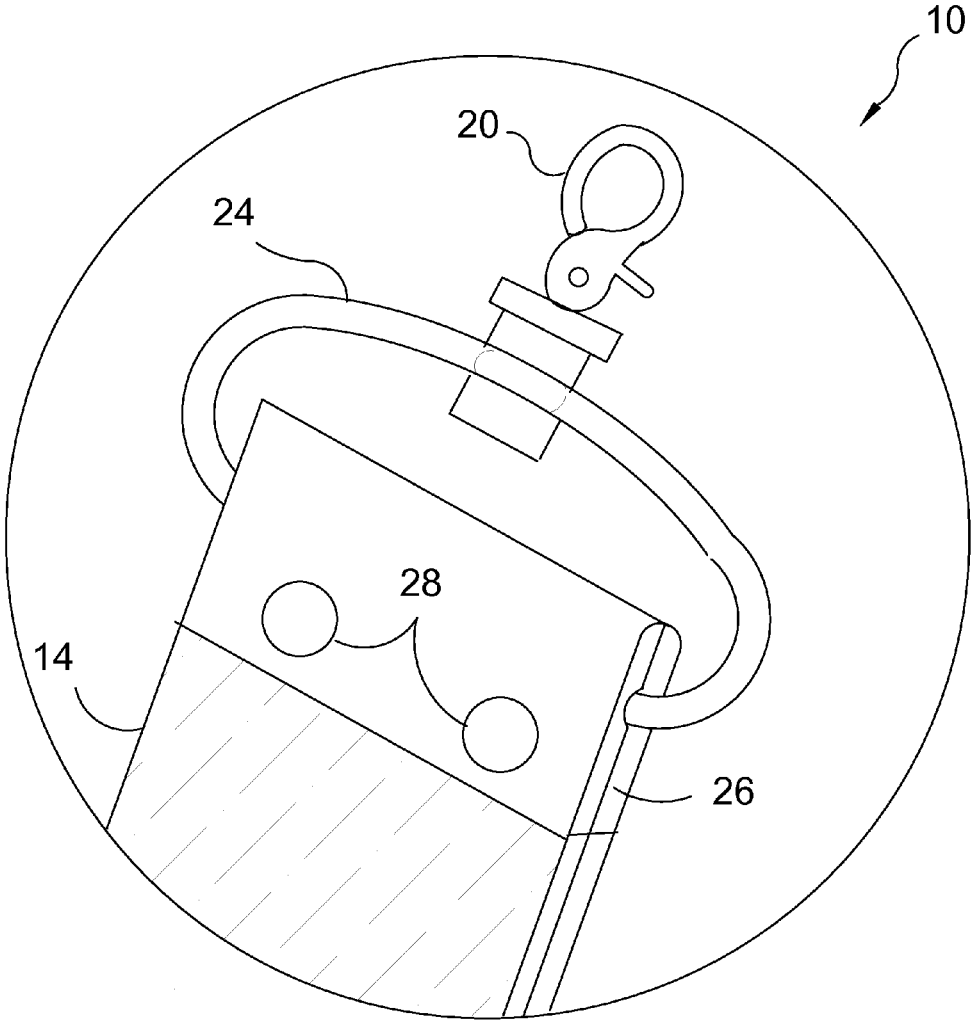
FIG. 3 is a detail view of the pivot head of the present invention.

FIG. 3 is a detail view of the swivel trigger snap 20 of the present invention 10. Shown is the swivel trigger snap 20 connected to the body 14 by a metal loop 24 passing through a sueded leather loop 26 secured to the body 14 by a pair of metal rivets 28.

Figure 4:
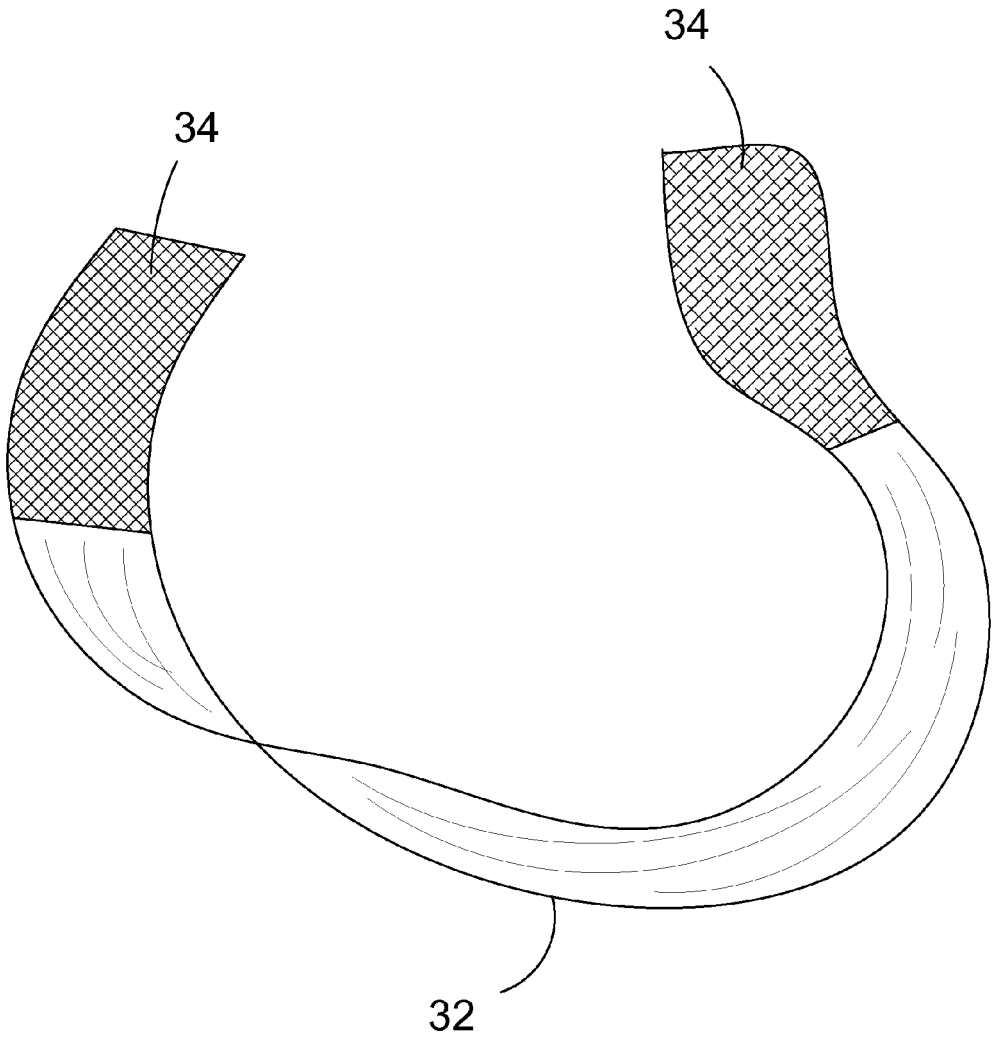
FIG. 4 is a perspective view of the Velcro strap of the present invention.

FIG. 4 is a perspective exploded view of the extension strap 32 of the present invention 10. The extension strap 32 has mating hook and loop fastener elements 34 to provide versatility for securing to various anchoring articles.

Figure 5:
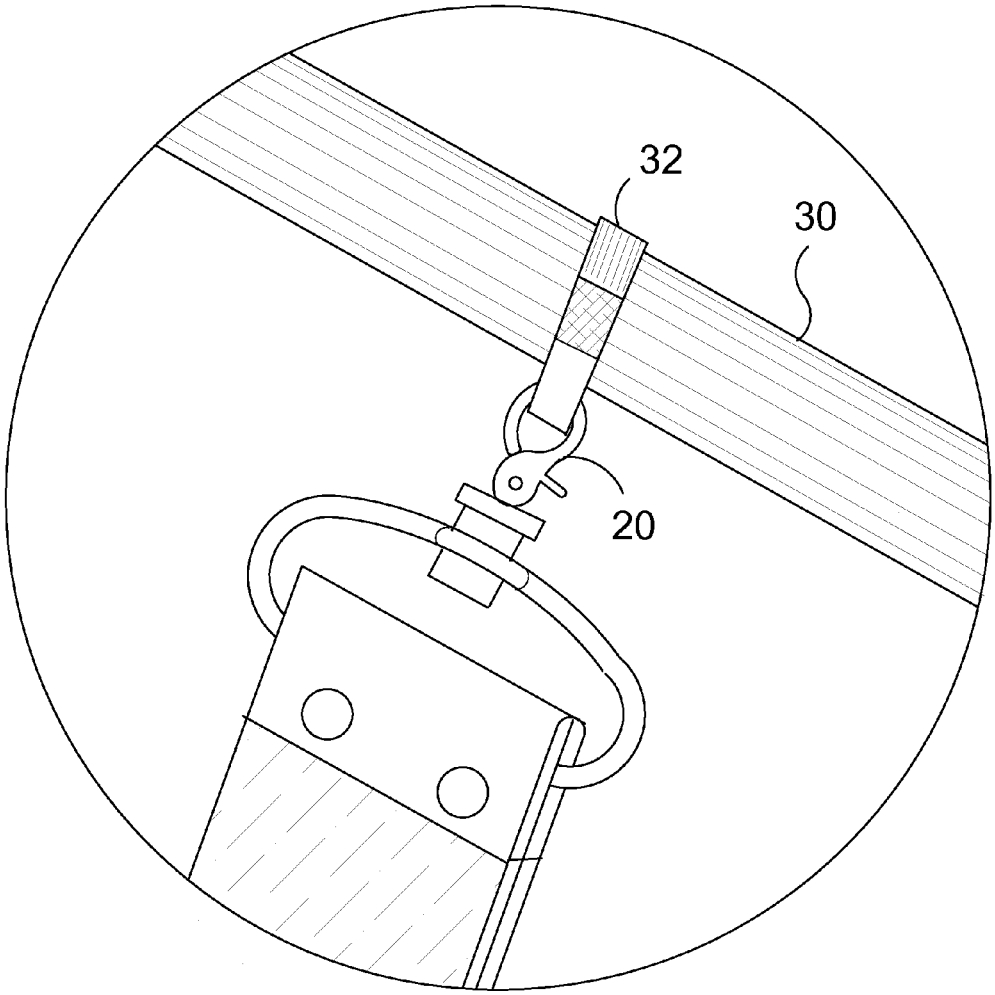
FIG. 5 is a view the Velcro strap of the present invention in use.

FIG. 5 is a detail view of the present invention 10. Shown is the extension strap 32 being employed to accommodate usage with an anchoring article 30 larger than the swivel trigger snap 20 can receive. The extension strap 32 passes through the swivel trigger snap 20 and is wrapped around the anchoring article 30. The hook and loop fastener elements 34 enable the user to adjust to various sized anchoring articles 30.

Figure 6:
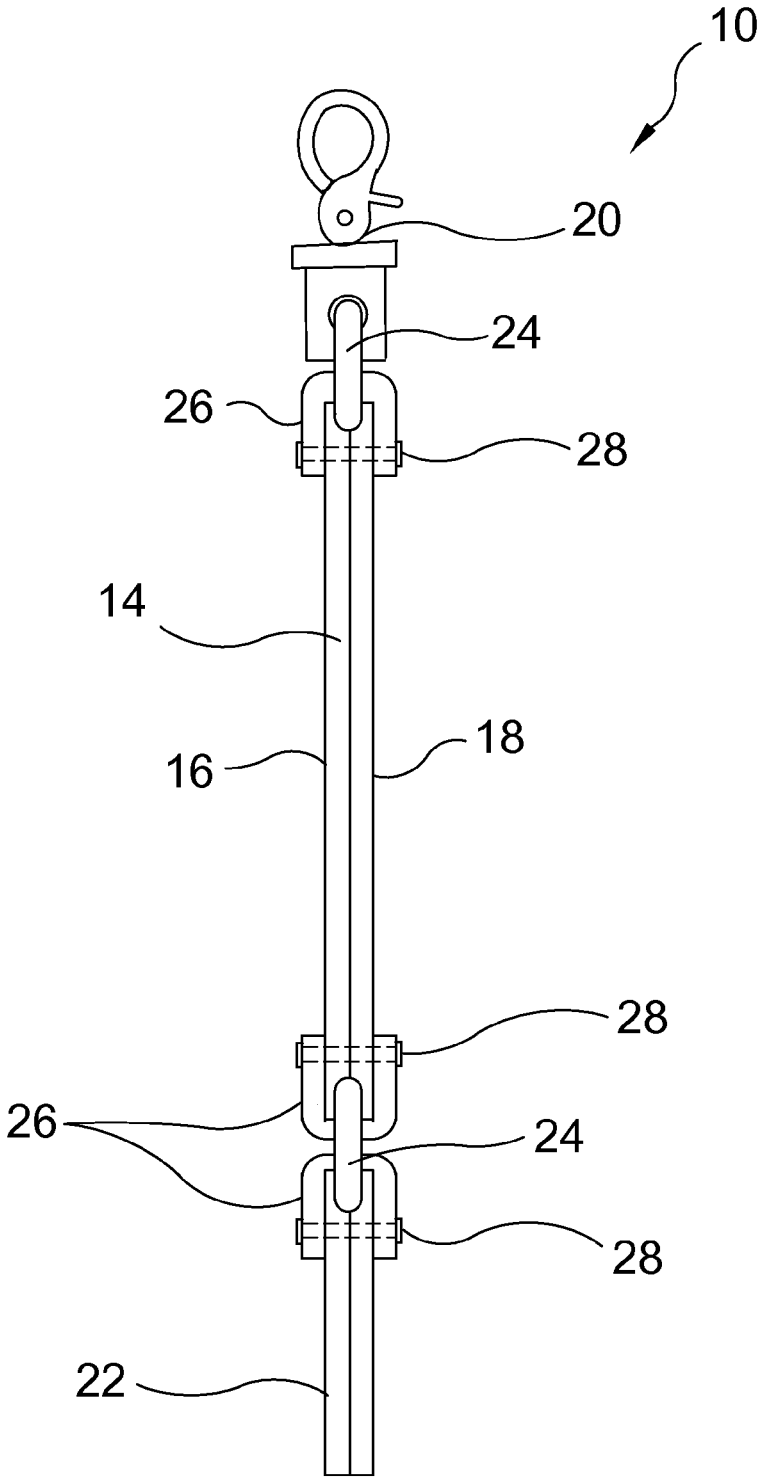
FIG. 6 is a side view of the present invention.

FIG. 6 is a side view of the present invention 10 demonstrating the physical relationship between the smooth surface and the rough side of said body 14, the sueded leather loops 26, the rivets 28, the metal loops 24, the swivel trigger snap 20 and the handle 22.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A mini-strop for honing and sharpening razors to extend the usable life thereof comprising:

a) a body having a smooth strip of leather bonded in back to back fashion with a rough strip of leather so that the smooth and the rough strips of leather each has an exposed surface for honing and sharpening;

b) a swivel trigger snap disposed on the top end of said body;

c) a handle disposed on the bottom end of said body;

d) wherein said body has sheer leather looped strips on the top end and the bottom end thereof;

e) wherein said handle has a sheer sueded leather looped strip disposed on the top portion thereof; and f) said swivel trigger snap is secured to said body by a metal loop passing through the sheer leather looped strip at the top end of the body, said handle is secured to the body by a metal ring passing through the sheer leather looped strip at the bottom end of the body and the sheer sueded leather looped strip on the top portion of the handle.

2. The mini-strop for honing and sharpening safety razors according to claim 1, wherein said sheer sueded leather looped strip is secured to the handle by a pair of spaced apart double sided medium rivets.

3. The mini-strop for honing and sharpening safety razors according to claim 2, wherein said swivel trigger snap is capable of being hooked onto an anchoring article.

4. The mini-strop for honing and sharpening safety razors according to claim 3, further including an extension strap with ends having hook and loop elements.

5. The mini-strop for honing and sharpening safety razors according to claim 4, wherein said extension strap is attachable to said swivel trigger snap and capable of being looped around an anchoring article and fastened to the anchoring article by the hook and loop elements.

6. A mini-strop for honing and sharpening safety razors to extend the usable life thereof comprising:

a) a body having a smooth strip of leather bonded in back to back fashion with a rough strip of leather so that the smooth and the rough strips of leather each has an exposed surface for honing and sharpening;

b) a swivel trigger snap disposed on the top end of said body;

c) a handle disposed on the bottom end of said body;

d) wherein said strips are is fabricated of double shoulder premium cow leather strips; and e) wherein the exposed surface of said smooth strip is provided with a texture by sanding with a 400 grit fine sand paper.

7. The mini-strop for honing and sharpening safety razors according to claim 6, wherein the bonding agent of said smooth strip and said rough strip is rubber cement.

8. The mini-strop for honing and sharpening safety razors according to claim 7, wherein said handle is fabricated of two pieces of double shoulder cow leather that are bonded back to back with rubber cement.

9. The mini-strop for honing and sharpening safety razors according to claim 8, wherein both sides of said handle are sanded with 400 grit sandpaper to achieve a soft grip.

10. A method for honing and sharpening safety razors comprising the steps:

a) providing a mini strop having a body with two bonded strips of double shoulder premium cowhide with one side being smooth and the other being rough sueded leather, a handle disposed on the bottom end of said body, a swivel trigger snap disposed on the top end of said body, and an extension strap having mating hook and loop fasteners disposed on its opposing ends;

b) wrapping said extension strap around an attachment article and securing said opposing ends together with said mating hook and loop fasteners, securing said swivel trigger snap to said extension strap;

c) pulling said handle down so said body is taut;

d) applying the blades of a safety razor to be sharpened/honed against the surface of said rough side and moving it as if shaving upward or downward in the same direction several times thereby honing and sharpening said blades, e) reversing the motion and repeating for the same number of times as performed in the other direction;

f) rotating said strop to reveal said smooth side;

g) repeating the procedure performed on said smooth side thereby shaping said blades to give them a keen edge.

11. The method for honing and sharpening safety razors according to claim 10, providing a texture to an exposed surface of said smooth strip by sanding with a 400 grit fine sandpaper prior to applying the blades of the safety razor to the exposed surface of the smooth strip.

* * * * *